US006461235B2

(12) United States Patent
Rutler et al.

(10) Patent No.: US 6,461,235 B2
(45) Date of Patent: Oct. 8, 2002

(54) TEMPORARY VENT OPENING COVER

(75) Inventors: Jay B. Rutler, Overland Park, KS (US); Spencer B. Hawerlander, Olathe, KS (US); Tony Robert Plunkett, Olathe, KS (US)

(73) Assignee: Rutland, Inc., Olathe, KS (US)

( * ) Notice: Subject to any disclaimer, the term of this patent is extended or adjusted under 35 U.S.C. 154(b) by 0 days.

(21) Appl. No.: 09/737,086

(22) Filed: Dec. 14, 2000

(65) Prior Publication Data

US 2002/0077059 A1 Jun. 20, 2002

(51) Int. Cl.[7] ..... F24F 13/28
(52) U.S. Cl. ..... 454/289; 55/385.2; 454/370
(58) Field of Search ..... 454/289, 370; 55/385.2

(56) References Cited

U.S. PATENT DOCUMENTS

| | | | | | |
|---|---|---|---|---|---|
| 674,991 | A | * | 5/1901 | Williams | 126/201 |
| 1,429,811 | A | * | 9/1922 | Tynan | 160/179 |
| 1,488,694 | A | * | 4/1924 | Marks | 454/289 |
| 1,911,851 | A | * | 5/1933 | Scholtz | 454/289 |
| 2,080,726 | A | * | 5/1937 | Lowinger | 160/19 |
| 2,743,660 | A | * | 5/1956 | Sherff | 126/544 |
| 3,232,205 | A | | 2/1966 | Bumstead | |
| 3,589,265 | A | | 6/1971 | Hedrick | |
| 4,502,368 | A | | 3/1985 | Hempel | |
| 4,712,343 | A | | 12/1987 | Dearing et al. | |
| 4,773,308 | A | * | 9/1988 | Allen, Jr. | 454/131 |
| 4,829,886 | A | | 5/1989 | Battaglin | |
| 5,100,445 | A | * | 3/1992 | Johnson et al. | 55/413 |
| 5,180,331 | A | | 1/1993 | Daw et al. | |
| 5,266,091 | A | | 11/1993 | McDonald | |
| 5,597,392 | A | | 1/1997 | Hawkins et al. | |
| 5,720,660 | A | * | 2/1998 | Benedetto et al. | 454/284 |
| 5,947,815 | A | | 9/1999 | Danforth | |
| 6,066,044 | A | | 5/2000 | Orendorff | |

* cited by examiner

*Primary Examiner*—Harold Joyce
(74) *Attorney, Agent, or Firm*—Shughart Thomson & Kilroy P.C

(57) ABSTRACT

A temporary vent opening cover is disclosed which is securable over a vent opening in a floor or other surface during building construction to prevent debris from entering the vent opening and accumulating in duct work associated therewith. The cover includes a generally flat cover plate which is sized and shaped to cover the vent opening. The cover plate is spaced outwardly from the surface when the vent opening cover is secured over the vent opening. A plurality of air passages allow air to flow past the cover plate between the duct work and the workspace. A layer of air filter material covers the air passages and prevents debris from passing therethrough. A portion of cover plate may be dedicated to the display of promotional indicia.

8 Claims, 3 Drawing Sheets

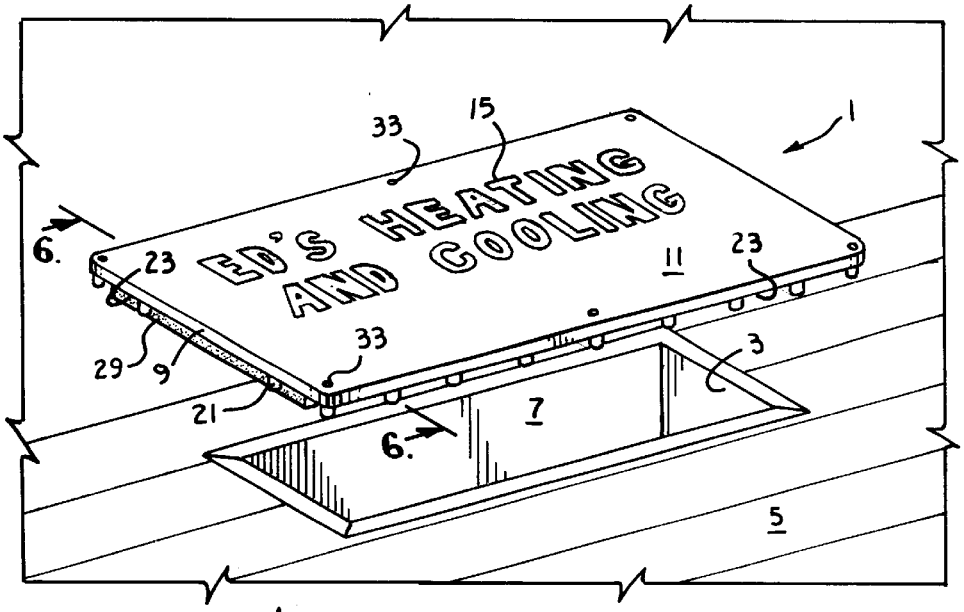
Fig.1.
Fig.2.
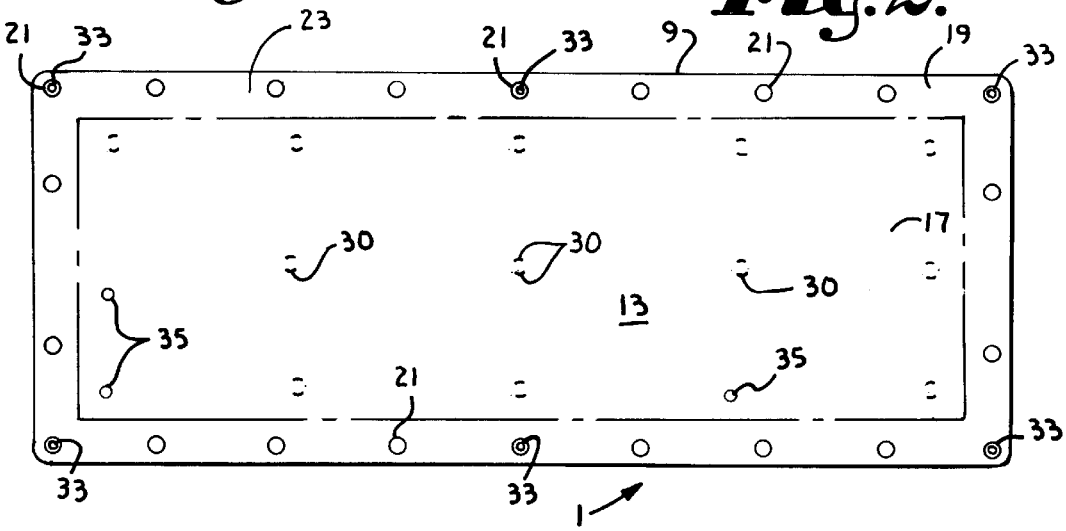
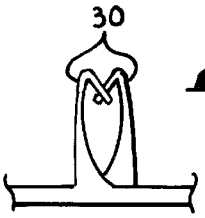
Fig.5.

Fig. 3.
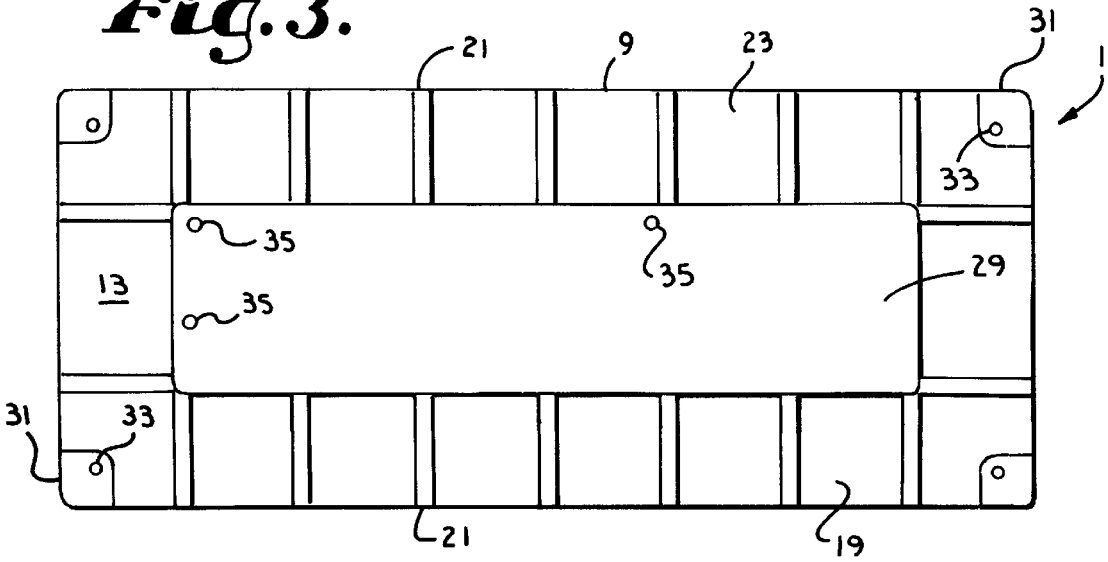
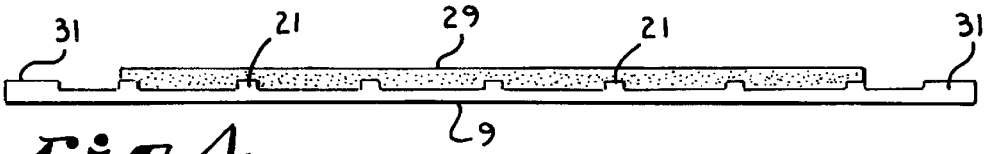
Fig. 4.
Fig. 6.
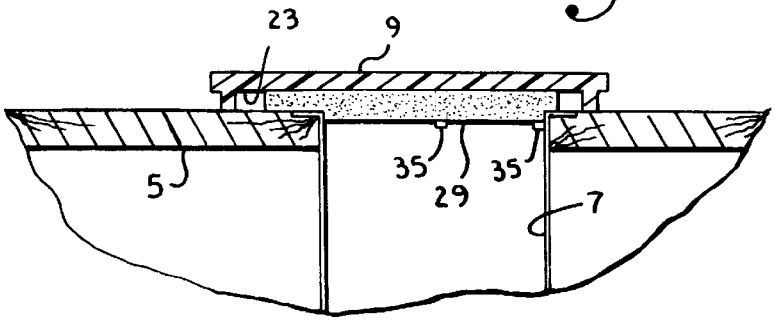

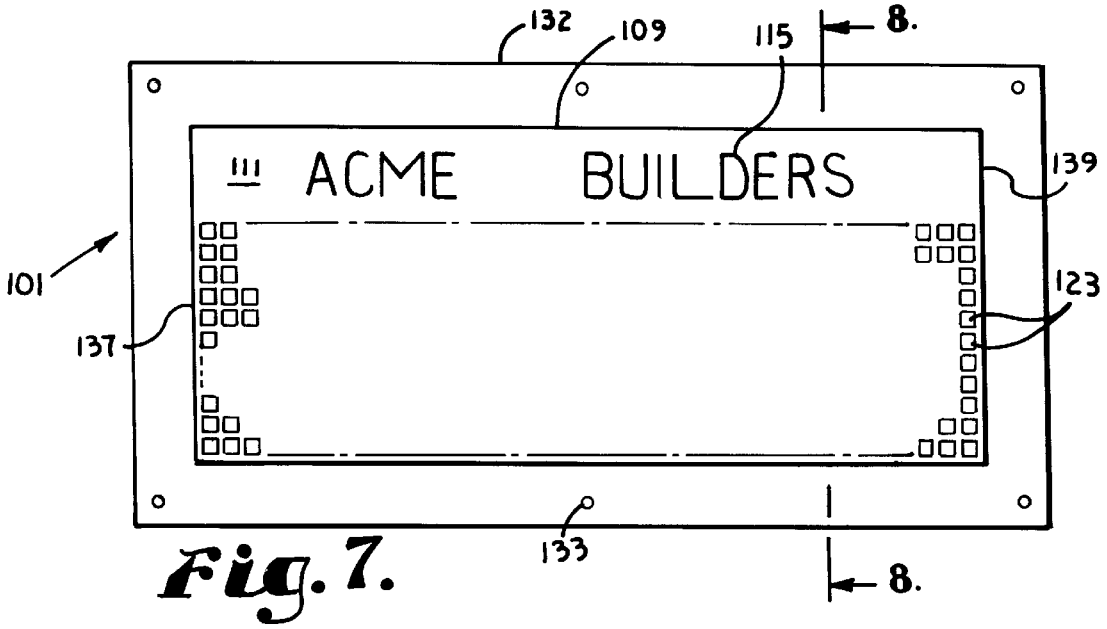
Fig. 7.
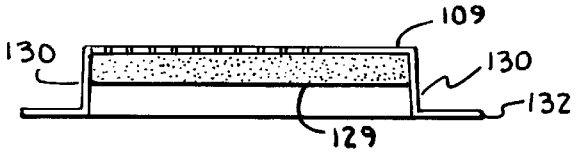
Fig. 8.
Fig. 9.
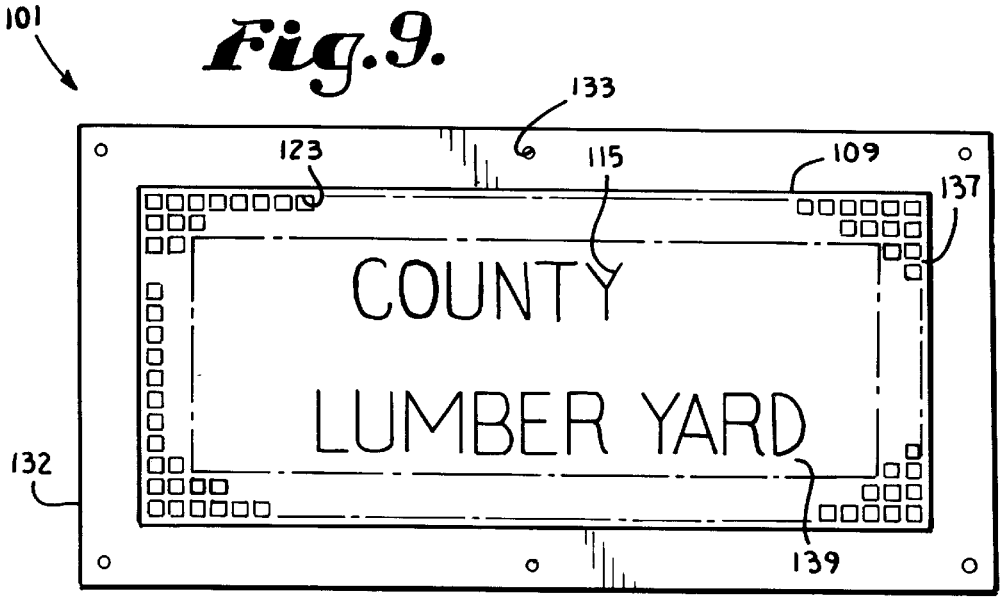

TEMPORARY VENT OPENING COVER

BACKGROUND OF THE INVENTION

1. Field of the Invention

The invention relates generally to the field of building construction supplies, and more particularly to a cover for temporary installation over a floor vent opening to prevent construction debris from accumulating in the duct work.

2. Description of the Related Art

Homes and other buildings often include floor mounted vents which are associated with the building's heating, ventilation, and air conditioning (HVAC) systems. These floor vents may serve either as supply vents for providing fresh air to a room or as return vents for circulating air from the room back to the furnace or air conditioner. The vents are connected to the HVAC system through a system of duct work.

When a building is constructed, the vent openings and duct work are often roughed in early in the construction process and finish work continues for a substantial period of time thereafter. The grills or gratings which will eventually cover the vent openings are not generally installed until the later phases of the construction. If the vent openings are simply left open until the finish work is completed, debris from the continuing construction can fall through the openings and accumulate in the associated duct work. If the debris is not removed from the ducts it can partially block the flow of air through the duct and impair the efficiency of the HVAC system. In addition, small particles of debris such as sawdust and drywall dust can be blown out of the duct work and back into the living space, creating housekeeping problems and possibly even breathing difficulties for the building's occupants. It is therefore advantageous to prevent construction debris from entering the duct work through the floor vent openings. Open floor vent openings also present a safety hazard to personnel working around the construction site, as a worker can easily step into an unprotected opening and sustain personal injuries.

Those contractors who have previously attempted to address this problem have generally done so by covering the vent openings with a solid surface, such as a piece of sheet metal or plywood. While this method is effective for preventing debris from falling into the vent openings, it also prevents the construction workers from enjoying the benefits of having the HVAC system operating while they complete their work.

What is needed is a temporary cover for the vent openings which prevents even small debris from entering the duct work, but which allows air to flow through the opening so that the HVAC system can be operated during construction. A previous solution to this problem is disclosed by U.S. Pat. No. 4,829,886 to George Battaglin entitled Central Heating System Vent Guard. The Battaglin device comprises a guard with a central recess or trap and a circumferential flange which surrounds the recess. The recess is designed to extend downwardly into the vent opening such that the flange is generally in contact with the floor adjacent to the opening. The flange includes a plurality of raised portions which allow air to pass between the flange and the floor. One disadvantage of this device is that its usage would still allow dust and small debris items to be inadvertently swept into the vent openings through the air passages during routine site clean-up. This problem is compounded if the cover is not securely fastened to the floor and lifts up when pushed against by a broom. A second problem is that the recess in the guard represents a safety hazard in that it provides an opening into which a person could step, causing injury. In addition, debris which collects in the recess cannot be swept out and will have to be manually removed from the recess, making clean-up more difficult.

SUMMARY OF THE INVENTION

The present invention comprises a temporary cover for use during building construction to prevent debris from entering floor vent openings. The cover has a generally flat upper surface which allows any debris which accumulates on the cover to be simply swept or vacuumed away. The cover further includes a plurality of air passages which allow the HVAC system to be operated with the covers in place so that the construction workers can work in a heated or air conditioned environment. The air passages are protected by a layer of filter material which helps prevent small debris from entering the vent opening through the air passages.

An additional function of the generally flat upper surface of the cover is that it can serve as a location for the printing of logos or other promotional indicia. This feature would allow a business such as a contractor, lumberyard, or furnace or air conditioning equipment supplier to place their company name or advertising on the vent covers where it would be seen by other persons in the building trades who might purchase their products or services. Promotional logos directed toward homeowners could also be printed on the cover to promote a business's goods and services to potential home buyers viewing the house under construction.

OBJECTS AND ADVANTAGES OF THE INVENTION

The principal objects and advantages of the present invention include: providing a temporary vent opening cover for preventing debris from entering duct work through a vent opening during building construction; providing such a vent opening cover which includes air passages which allow air to circulate therethrough so that the associated HVAC system can be operated during construction; providing such a vent opening cover which is easy to clean around without causing debris to be swept into the vent opening; providing such a vent opening cover having filter material to help prevent smaller debris from passing through the air passages; providing such a vent opening cover which has at least one relatively large flat surface which can display logos or other promotional indicia; and providing such a vent opening cover which is economical to manufacture, durable, and particularly well-adapted for the proposed usage thereof.

BRIEF DESCRIPTION OF THE DRAWINGS

FIG. 1 is an exploded perspective view showing a temporary vent opening cover embodying the present invention over a floor vent opening.

FIG. 2 is a bottom view of the vent opening cover of FIG. 1 with the filter material removed.

FIG. 3 is a bottom view of a vent opening cover similar to the vent opening cover of FIG. 1, but with legs shaped in the form of ribs.

FIG. 4 is a side view of the vent opening cover of FIG. 3.

FIG. 5 is a greatly enlarged perspective view of the filter material attaching hooks of the vent opening cover.

FIG.6 is a cross-sectional view of the vent opening cover installed over a floor vent opening taken generally along line 6—6 in FIG. 1.

FIG. 7 is a top view of a modified embodiment of the vent opening cover showing the cover plate divided longitudinally between perforated and nonperforated portions.

FIG. 8 is a cross-sectional view of the modified embodiment of the vent opening cover taken generally along line 8—8 in FIG. 7.

FIG. 9 is a top view of the modified embodiment of the vent opening cover showing the cover plate having a central nonperforated portion and a peripheral perforated portion.

DETAILED DESCRIPTION OF THE PREFERRED EMBODIMENTS

I. Introduction

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

II. First Embodiment

Referring to the drawings in more detail, the reference number 1 generally designates a vent opening cover embodying the present invention. The cover 1 is especially designed to cover a vent opening 3 in a floor 5, to prevent debris from entering the associated duct work 7, however the cover 1 may also be used to cover similar vent openings in walls, ceilings, or other surfaces if there is danger of debris entering these openings under the particular conditions of the job site.

The cover 1 can be formed by a variety of methods from any of a wide variety of strong, durable materials, however a preferred construction technique is to form the cover 1 of injection molded ABS or other highly impact resistant plastic. The cover 1 includes a generally rectangular cover plate 9 which is sized and shaped to completely cover the vent opening 3 and overlap a portion of the floor 5. The cover plate 9 is preferably of a size that allows a single cover 1 to used to cover any of a variety of standard size vent openings 3 such as 2"×10", 4"×10" and 4"×12" openings, for example. It is foreseen, however, that the cover 1 could also be manufactured in a variety of sizes and shapes to cover vent openings 3 of widely divergent sizes.

The cover plate 9 has a top surface 11 and a bottom surface 13. The top surface 11 is generally flat and can provide a location for a logo or other promotional indicia 15 which can be affixed to the cover 1 in any known manner, such as by printing, engraving, embossing, or the use of adhesive stickers or decals. The bottom surface 13 of the cover plate 9 is generally divided into a central portion 17, which is somewhat larger than the largest vent opening 3 over which the cover 1 is to be used, and a peripheral portion 19 which surrounds the central portion 17.

The cover plate 9 is spaced outwardly from the floor 5 by a plurality of legs or pedestals 21 which extend downwardly from the peripheral portion 19 of the bottom surface 13. The legs 21 can be of any of a variety of shapes; for example, the legs 21 are shown in FIGS. 1 and 2 as being cylindrical or tubular in shape, and in FIGS. 3 and 4 as being elongate ribs oriented transversely to the narrow dimensions of the peripheral portion 19.

In an injection molded cover 1 having rib shaped legs 21, the ribs would preferably have a thickness which is generally the same as the thickness of the cover plate 9. if the ribs 21 are substantially thicker than the plate 9, the thicker portions of the cover 1 adjacent to the ribs 21 will cool and contract at a different rate than the thinner portions and create sink marks in the top surface 11 over the ribs 21. These sink marks would detract from the appearance of the cover 1 and adversely affect the application of the promotional indicia 15.

The spaces between the legs 21 define a plurality of air channels 23 which allow air to pass between the cover plate 9 and the floor 5 so that airflow between the duct work 7 and the surrounding room or workspace may be maintained with the cover 1 in place. A pad of open-cell foam air filter material 29 having generally the same outer dimensions as the central portion 17 of the plate 9 is installed over the central portion 17, between the legs 21. The filter material 29 has a thickness which is at least equal to the height of the legs 21, and is preferably somewhat thicker, so that the edges of the pad 29 will be compressed between the floor 5 and the cover plate 9 when the cover 1 is installed over the vent opening 3, creating a tight seal.

The filter material 29 may be attached to the bottom surface 13 of the plate 9 by use of an adhesive or by any of a variety of known methods, or the central portion 17 of the plate 9 may be provided with a plurality of hooks 30 which are designed to penetrate the filter material 29 and hold it in place relative to the cover plate 9. In order to provide the surest grip on the filter material 29, the hooks 30 are preferably arranged in closely spaced pairs as shown in FIG. 5, the hooks 30 in the pair having their barbs pointing in opposite directions. The opposedly paired hooks 30 also have the function of creating localized tension in the filter material 29. This tension pushes the filter material 29 onto the barbs of the hooks 30 and helps to hold the filter material 29 in place relative to the cover plate 9.

The cover 1 is temporarily secured to the floor 5 by screws or other fasteners which are inserted through mounting holes 31 extending through the cover plate 9. The mounting holes 31 are preferably positioned proximate each of the four corners of the cover plate 9 and midway along the longer sides of the plate 9. If the cover 1 includes tubular legs 21, the mounting holes 31 may each be located over a respective one of the legs 21 so that fastener extends through the center of the leg 21. If the cover 1 has legs 21 which cannot accommodate the fasteners, such as the rib-like legs shown in FIGS. 3 and 4, then mounting bosses 33 can be added to provide locations for the mounting holes 31. The mounting bosses 31 extend downward from the bottom surface 13 of the cover plate 9 and have a height which is equal to the height of the ribs 21.

The cover 1 may also include two or more registration pegs 35 (three shown) which depend downward from the central portion 17 of the cover plate 9 at points which correspond to edges of the vent opening 3. The registration pegs 35 serve to help locate the cover 1 over the vent opening 3.

In use, the cover 1 is placed over the vent opening 3 with the registration pegs 35 each engaging edges of the floor 5 adjacent the opening 3, and secured in place with screws or other fasteners inserted through the mounting holes 33.

When the cover 1 is so installed, the air channels 23 each become bounded on their bottom sides by the floor 5. The filter material 29 is compressed around its peripheral edges between the floor 5 and the cover plate 9, creating a seal between the filter material 29 and the floor 5. The channels 23 allow air to flow between the duct work 7 and the room through the opening 3, however the channels 23 are protected by the filter material 29 which restricts the entry of debris into duct work 7 through the air channels 23.

III. Second Embodiment

An alternative embodiment of the present invention, vent opening cover 101, is shown in FIGS. 7–9. The vent opening cover 101 shares many of the features of the cover 1, in that it includes a cover plate 109 having a generally flat top surface 111, portions of which may serve as a location for the printing of promotional indicia 115, and a plurality of air passages 123 which are protected by a layer of filter material 129.

The cover 101 differs from the cover 1 primarily in that the cover plate 109 is raised above the level of the floor 5 by sidewalls 130 and the air passages 123 are formed through the cover plate 109 instead of being located between the cover plate 109 and the floor 5. These modifications make it possible to clean around the cover 101 without risk of debris being swept into the air passages 123, as can sometimes occur with the passages 23 of the cover 1. While the filter material 29 of the cover 1 generally restrains such swept-in debris from entering the duct work 7, this debris can clog the air passages 23 and prevent air from passing therethrough.

The cover plate 109 of the vent opening cover 101 is generally sized and shaped to match the vent opening 3. The sidewalls 130 extend downward from the outer edges of the plate 109 to a peripheral mounting flange 132 and present a solid barrier which prevents the passage of debris between the floor 5 and the cover plate 109. A plurality of mounting holes 133 are formed through the flange 132 for the insertion of nails, screws, or other like fasteners for securing the cover 101 to the floor 5.

The air passages 123 of the cover 101 take the form of a plurality of openings passing through the cover plate 109. While the air passages 123 are shown in the drawings as being square holes, it is to be understood that the shape of the openings is not critical and that the air passages may be of various configurations, including holes of any shape, slots, and louvers. The air passages 123 should, however, be arranged so as to leave a relatively large, flat, nonperforated area of the cover plate 109 free for the application of promotional indicia 115. This can be accomplished, for example, by dividing the cover plate 109 lengthwise into a perforated section 137 and an nonperforated section 139, as shown in FIGS. 5 and 6. Alternatively, the nonperforated section 139 may be located in the center of the cover plate 109, with the perforated section 137 around the periphery of the plate 109 as shown in FIG. 7.

The filter material 129 is attached to the underside of the cover plate 109 by an adhesive, hooks molded into the cover plate 109, or other means known in the art so as to protect the air passages 123 and prevent debris, generally in the form of dust, from entering the duct work 7 therethrough.

It is to be understood that while certain forms of the present invention have been illustrated and described herein, it is not to be limited to the specific forms or arrangement of parts described and shown.

What is claimed and desired to be secured by Letters Patent is as follows:

1. A temporary vent opening cover securable over a vent opening in a surface of a room during construction to prevent debris from entering the vent opening and accumulating in duct work associated therewith, comprising:

a) a cover plate sized and shaped to cover the vent opening, said cover plate having a central portion, a peripheral portion and an inner face, said central portion extending across a substantial portion of said vent opening and said inner face being spaced outwardly from the substantial portion of said vent opening cover is secured over the vent opening;

b) a plurality of air passages extending through the central portion of said cover plate and allowing air to flow past said cover plate between the duct work and the room; and c) a layer of air filter material attached to said inner face of said cover plate and covering said air passages.

2. The temporary vent opening cover as in claim 1, wherein said cover plate has an outer surface which includes a flat and contiguous portion sized to have promotional indicia printed thereon which is sized to be viewable by a person standing in the room in which the temporary vent opening cover is secured.

3. The temporary vent opening cover as in claim 1 which includes a plurality of registration members extending outwardly from said cover plate inner face for locating said vent opening cover relative to the vent opening.

4. The temporary vent opening cover as in claim 1 wherein said cover plate is formed from molded plastic.

5. A temporary vent opening cover securable over a vent opening in a surface of a room during construction to prevent debris from entering the vent opening and accumulating in duct work associated therewith, said cover comprising:

a) a central portion and a peripheral portion; said peripheral portion securable to the surface of a room around the periphery of a vent opening therein; said central portion being generally flat and extending across said vent opening and having an inner face spaced outwardly from the surface of the room when said vent opening cover is secured across the vent opening.

b) a plurality of air passages extending through said central portion of said cover and allowing air to flow past said cover between the duct work and the room; and c) a layer of air filter material attached to said cover and against said inner face of said central portion and covering said air passages extending therethrough.

6. The temporary vent opening cover as in claim 5, wherein said central portion of said cover has an outer surface which includes a flat and contiguous portion sized to have promotional indicia printed thereon which is sized to be viewable by a person standing in the room in which the temporary vent opening cover is secured.

7. The temporary vent opening cover as in claim 5 which further includes a plurality of registration members extending outwardly from said central portion inner face for locating said vent opening cover relative to the vent opening.

8. The temporary vent opening cover as in claim 5 wherein said cover is formed from molded plastic.

* * * * *

UNITED STATES PATENT AND TRADEMARK OFFICE

CERTIFICATE OF CORRECTION

PATENT NO. : 6,461,235 B2
DATED : October 8, 2002
INVENTOR(S) : Jay B. Rutler et al.

It is certified that error appears in the above-identified patent and that said Letters Patent is hereby corrected as shown below:

Column 6,
Line 11, delete "substantial portion of" and replace with -- surface when --.

Signed and Sealed this

Twenty-fifth Day of February, 2003

JAMES E. ROGAN
*Director of the United States Patent and Trademark Office*